US006474274B2

(12) United States Patent
Lehman

(10) Patent No.: US 6,474,274 B2
(45) Date of Patent: Nov. 5, 2002

(54) FLYWHEEL ENERGY STORAGE SYSTEM FOR MAINTAINING FAN SPEED FOR COOLING SYSTEM

(75) Inventor: David L. Lehman, Metamora, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/736,985

(22) Filed: Dec. 14, 2000

(65) Prior Publication Data

US 2002/0073941 A1 Jun. 20, 2002

(51) Int. Cl.[7] ..... F01P 7/10
(52) U.S. Cl. ..... 123/41.49; 123/41.11
(58) Field of Search ..... 123/41.12, 41.49

(56) References Cited

U.S. PATENT DOCUMENTS

| | | | |
|---|---|---|---|
| 3,476,201 | A | 11/1969 | Swaine |
| 3,485,037 | A | 12/1969 | Clerk |
| 3,493,066 | A | 2/1970 | Dooley |
| 3,805,638 | A | 4/1974 | Herdzina |
| 3,882,950 | A | 5/1975 | Strohlein |
| 4,305,489 | A | 12/1981 | Hoppie |
| 4,593,798 | A | 6/1986 | Yew |
| 4,618,334 | A | 10/1986 | Miranti, Jr. |
| 5,065,060 | A | 11/1991 | Takahashi et al. |

FOREIGN PATENT DOCUMENTS

| | | | |
|---|---|---|---|
| DE | 3345340 | * | 6/1985 |

* cited by examiner

*Primary Examiner*—Noah P. Kamen
(74) *Attorney, Agent, or Firm*—Andrew M. Calderon

(57) ABSTRACT

A flywheel energy storage system for maintaining fan speed of a cooling fan on an internal combustion engine. The flywheel energy storage system allows a fan to rotate independent of the internal combustion engine and use energy stored in a flywheel for the continued rotation of the fan when a speed of the internal combustion engine falls below a predetermined speed. In this manner, the fan can provide an adequate air flow to cool the components of the internal combustion engine regardless of the speed of the internal combustion engine. To accomplish this, a fan is coupled to a clutch and a flywheel.

18 Claims, 2 Drawing Sheets

FLYWHEEL ENERGY STORAGE SYSTEM FOR MAINTAINING FAN SPEED FOR COOLING SYSTEM

TECHNICAL FIELD

This invention relates generally to a cooling system and, more particularly, to a flywheel energy storage system for maintaining fan speed of a cooling fan on an internal combustion engine.

BACKGROUND ART

Internal combustion engines include many components that generate heat during operation of the internal combustion engine. These components may include, for example, pistons, rings, injectors, valves and the like. Above a certain temperature, the components are likely to overheat potentially resulting in a failure of the internal combustion engine. Accordingly, these components must be cooled during the operation of the internal combustion engine in order for the internal combustion engine to function in the most efficient and economical manner.

To cool these components, a cooling system is used during the operation of the internal combustion engine. One type of cooling system is a fan driven system which is driven via a pulley and belt system by the internal combustion engine. By using a belt driven fan system, the rotation of the fan will generate an air flow which will cool the components, i.e., decrease the operating temperature of the components of the internal combustion engine.

The rotation of the fan of these type of systems is dependent on the speed (revolution per minutes) of the internal combustion engine. That is, a higher engine speed will result in a higher fan speed. Of course, the higher fan speed will generate a higher air flow over the components of the internal combustion engine. This higher air flow, in turn, will cool the components of the internal combustion engine thereby ensuring the reliability and efficiency of the engine. Thus, in a high speed mode of the internal combustion engine, typical fan driven systems adequately cool the engine by generating a sufficient air flow to cool the engine components.

It follows then that at lower engine speeds, and in particular at an idle speed of the engine, the fan speed will not generate a high air flow. In these states, the engine components will not be adequately cooled, even though the components may still exceed a threshold temperature. This can result in a catastrophic failure of the engine components and thus significantly reduce the life of the internal combustion engine.

It is of critical importance to cool the engine components at all times during the operation of the internal combustion engine, regardless of the operating speed of the internal combustion engine. First, the engine components still generate a significant amount of heat during the idle or low speed of the internal combustion engine. Second, the components may be at a very high temperature during the low or idle speed due to the fact that the internal combustion engine was previously at a higher engine speed, e.g., generating a higher temperature. Third, it is an excellent opportunity to cool the engine components at a low or idle speed prior to the engine performing at a higher speed and thus generating higher component temperatures.

U.S. Pat. No. 3,882,950 to Strohlein, which was issued on May 13, 1975, shows an engine with a cooling system. The engine cooling system includes an engine having a fan coupled directly thereto. As the engine speed increases so will the fan speed. Conversely, however, when the engine speed decreases so will the fan speed. Thus at low or idle engine speeds, the fan may not be capable of generating a sufficient amount of air flow to cool the components of the engine. This may lead to a failure or, in the least, an overheating of the engine.

The present invention is directed to overcoming one or more of the problems as set forth above.

DISCLOSURE OF THE INVENTION

In one aspect of the present invention a fan is coupled to both a flywheel and a clutch assembly. The flywheel stores energy.

In another aspect of the present invention a method of cooling an internal combustion engine using a fan is provided. In the method, a flywheel stores energy and a clutch drives the fan when the speed of the internal combustion engine is at or above a predetermined speed. The fan rotates independent of the internal combustion engine while maintaining a speed of the fan via energy stored in the flywheel.

In still another aspect of the present invention, an internal combustion engine is provided with an flywheel energy storage system. The internal combustion engine includes components which are cooled by a fan. A flywheel and clutch bearing assembly are coupled to the fan.

BEST MODE FOR CARRYING OUT THE INVENTION

Figure 1:
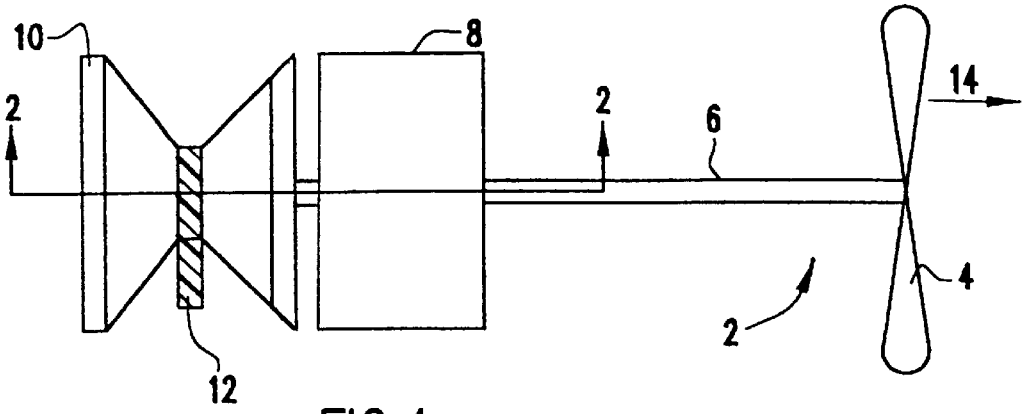
FIG. 1 shows a side diagrammatic view of a cooling fan system of the present invention.

FIG. 1 shows a cooling fan system adapted for use with an internal combustion engine and which is generally depicted as reference numeral 2. The cooling fan system 2 includes a fan 4 of known design coupled via a connecting rod 6 to a flywheel 8. The flywheel 8, in turn, is coupled to a driven pulley 10. Internal to the driven pulley 10 is a one way clutch assembly (shown in FIG. 2). At a predetermined engine speed or higher, the one way clutch assembly is coupled to the connecting rod 6. The driven pulley 10 is capable of accommodating a drive belt 12 (partially shown). Airflow in the direction of the arrow 14 is generated from the fan 4.

Figure 2:
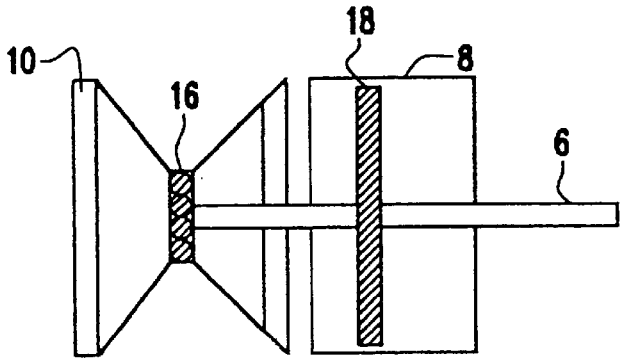
FIG. 2 shows a cross sectional view along line 2—2 of the cooling fan system of FIG. 1.

FIG. 2 shows a cross sectional view of the flywheel 8 and the one way clutch assembly 16. The flywheel 8 is of a conventional type and, in one embodiment, may include a disk 18 having a high rotational inertia. The disk 18 is attached to the connecting rod 6 about an axis of the disk 18. It should be realized by those of ordinary skill in the art that other types of flywheels may also be used with the present invention such as, for example, but not limited to, rim-type flywheels or flywheels having different weight distributions and rotary speeds, depending on the particular application of the present invention. The one way clutch assembly 16 is also a conventional type and, in one embodiment, may include a bearing and housing assembly housed within the driven pulley 12.

Figure 3:
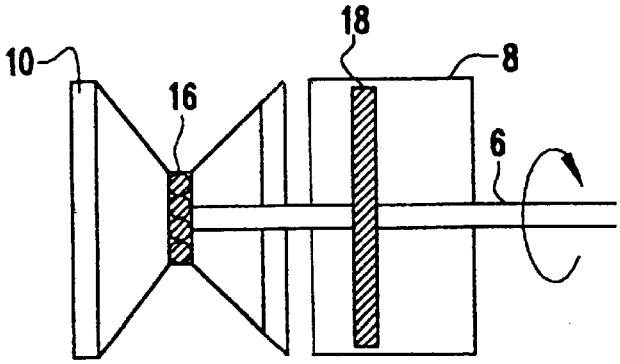
FIG. 3 shows a cross sectional view of the cooling fan system with a clutch disengaged from a connecting rod.

FIG. 3 shows a cross sectional view of the cooling fan system with the one way clutch assembly 16 disengaged from the connecting rod 6. As seen in the FIG. 3, the connecting rod 6 is de-coupled from the connecting rod 6. This occurs when the engine speed is below the predetermined speed.

Figure 4:
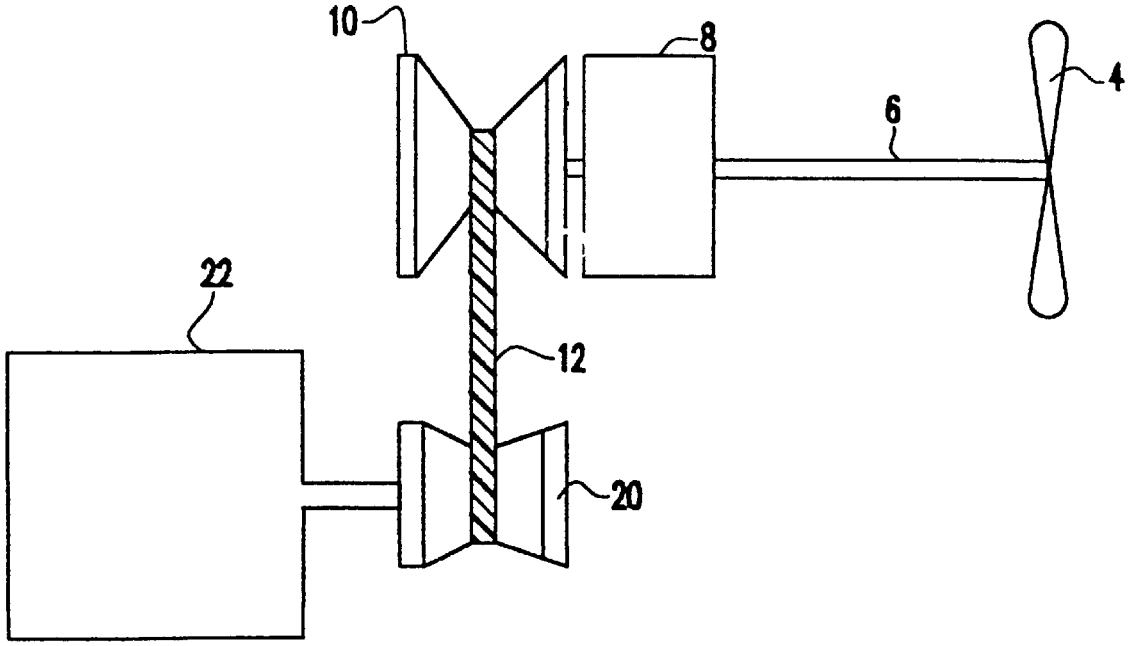
FIG. 4 shows a side diagrammatic view of the cooling fan system of the present invention connected to an internal combustion engine.

FIG. 4 shows a side diagrammatic view of the cooling fan system 2 connected to an internal combustion engine. In this view, the fan belt 12 is connected between the driven pulley 10 and a drive pulley 20 of an internal combustion engine 22.

INDUSTRIAL APPLICABILITY

In operation, the one way clutch bearing assembly 16 disengages from the fan 4 when the internal combustion engine 22 is driven below the predetermined speed (i.e., when the revolution per minutes of the internal combustion engine decreases from at least a full speed). The disengagement of the one way clutch bearing assembly 6 from the fan 4 results from low centrifugal forces generated from the engine speed. This enables the fan to rotate freely and independent of the internal combustion engine 22, and further enables the energy stored in the flywheel 8 to maintain and drive the fan 4 at a higher speed than the internal combustion engine 22. The energy stored in the flywheel 8 depends on both the weight distribution and the rotary speed of the flywheel 8 (resulting in a certain inertia).

More specifically, the driven pulley 10 is driven by the drive pulley 20 via the drive belt 12 at or above the predetermined speed (which may be a full speed) of the internal combustion engine 22. The one way clutch bearing assembly 16 of the driven pulley 10 engages the connecting rod 6 and transmits the speed of the internal combustion engine 20 to the fan 4. At the predetermined speed or higher, the flywheel 18 stores energy generated from the internal combustion engine 22. The fan 4 then generates an air flow 14 for cooling components of the internal combustion engine 22.

The one way clutch bearing assembly 16 disengages from the connecting rod 6 when the speed of the internal combustion engine 22 falls below the predetermined speed. This allows the fan 4 to rotate independent of the internal combustion engine 22 such that the speed of the fan 4 will not slow down at the same rate as the speed of the internal combustion engine. When the one way clutch bearing assembly 16 disengages from the connecting rod 6, the energy stored in the flywheel 8 is then used to maintain and drive the rotation of the fan 4 at a higher speed than the internal combustion engine 22 thus allowing the fan 4 to cool the components of the internal combustion engine 22 during all speeds of the internal combustion engine 22.

Other aspects and features of the present invention can be obtained from a study of the drawings, the disclosure, and the appended claims.

What is claimed is:

1. A flywheel energy storage system for cooling components of an internal combustion engine, comprising:

a fan connected to a connecting rod;

an energy storing flywheel coupled to the fan via the connecting rod; and a driven pulley having a clutch bearing assembly coupled therein, the clutch bearing assembly being connected to the connecting rod for driving the fan, wherein the energy storing flywheel is mounted on said connecting rod and adjacent said drive pulley.

2. The flywheel energy storage system of claim 1, wherein the energy storing flywheel stores energy when a speed of the internal combustion engine is at or greater than a predetermined speed.

3. The flywheel energy storage system of claim 2, wherein the clutch bearing assembly detaches from the fan and the energy stored in the energy storing flywheel is used to drive the fan when the speed of the internal combustion engine is below the predetermined speed.

4. The flywheel energy storage system of claim 1, including a connecting rod connecting the clutch bearing assembly to the fan.

5. The flywheel energy storage system of claim 4, wherein the clutch bearing assembly engages and rotates the connecting rod in a first direction when a speed of the internal combustion engine is at or greater than a predetermined speed.

6. The flywheel energy storage system of claim 4, wherein the clutch bearing assembly disengages from the connecting rod when the speed of the internal combustion engine is below the predetermined speed.

7. The flywheel storage energy system of claim 6, wherein the fan rotates independent of the speed of the internal combustion engine when the clutch bearing assembly disengages from the connecting rod.

8. The flywheel storage energy system of claim 6, wherein the energy stored in the energy storing flywheel maintains a speed of the fan when the clutch bearing assembly disengages from the connecting rod.

9. The flywheel storage energy system of claim 8, wherein the speed of the fan is greater than the speed of the internal combustion engine when the speed of the internal combustion engine initially falls below the predetermined speed.

10. The flywheel energy storage system of claim 6, wherein the predetermined speed is a full speed of the internal combustion engine.

11. A method of cooling an internal combustion engine using a fan, comprising the steps of:

engaging a clutch assembly located in a drive pulley to drive a connecting rod which is connected to the fan to drive the fan when the speed of the internal combustion engine is at or above the predetermined speed;

storing energy in a flywheel adjacent the drive pulley and connected to the connecting rod when the clutch assembly engages the fan;

disengaging the clutch assembly when the speed of the internal combustion engine is below the predetermined speed;

rotating the fan independent of the internal combustion engine after the clutch assembly is disengaged; and maintaining a speed of the fan using the energy stored in the flywheel when the fan is independently rotating.

12. The method of claim 11, wherein the predetermined speed is a full speed of the internal combustion engine.

13. The method of claim 11, wherein the speed of the fan is greater than the speed of the internal combustion engine when the speed of the internal combustion engine initially falls below the predetermined speed.

14. The method of claim 11, wherein the clutch assembly drives the fan in a single direction.

15. An internal combustion engine having a flywheel energy storage system, comprising;

components attached to the internal combustion engine;

a fan for cooling the components of the internal combustion engine, the fan being connected to a connecting rod;

an energy storing flywheel coupled to the fan via the connecting rod; and a driven pulley having a clutch bearing assembly coupled therein, the clutch bearing assembly being connected to the connecting rod for driving the fan when a speed of the internal combustion engine is at or greater than a predetermined speed, wherein the energy storing flywheel is mounted on said connecting rod and adjacent said drive pulley.

16. The internal combustion engine of claim 15, wherein the clutch bearing assembly disengages from the fan when the speed of the internal combustion engine is below the predetermined speed such that the fan rotates independent of the speed of the internal combustion engine.

17. The internal combustion engine of claim 16, wherein the flywheel stores energy when the speed of the internal combustion engine is at or greater than the predetermined speed.

18. The internal combustion engine of claim 17, wherein the energy stored in the energy storing flywheel is used to drive the fan when the speed of the internal combustion engine is below the predetermined speed.

* * * * *